US005970563A

United States Patent [19]

Monahan

[11] Patent Number: 5,970,563

[45] Date of Patent: Oct. 26, 1999

[54] BROOM HAVING WIRE BOUND FIBERS

[75] Inventor: Jon Monahan, Arcola, Ill.

[73] Assignee: The Thomas Monahan Company, Arcola, Ill.

[21] Appl. No.: 08/605,876

[22] Filed: Feb. 23, 1996

[51] Int. Cl.[6] ..... A46B 3/08

[52] U.S. Cl. ..... 15/189; 15/171

[58] Field of Search ..... 15/159.1, 171, 15/176.2, 189

[56] References Cited

U.S. PATENT DOCUMENTS

| | | | |
|---|---|---|---|
| 91,907 | 6/1869 | Burnett . | |
| 117,192 | 7/1871 | Middleton . | |
| 148,278 | 8/1874 | Anderson et al. . | |
| 156,324 | 10/1874 | Anderson et al. | 15/189 |
| 181,455 | 8/1876 | Lee, Jr. . | |
| 187,346 | 2/1877 | Barrett . | |
| 265,052 | 9/1882 | Flint . | |
| 267,444 | 11/1882 | Montgomery . | |
| 674,899 | 5/1901 | Bradt et al. . | |
| 931,290 | 8/1909 | Frazier . | |
| 949,577 | 2/1910 | Karst . | |
| 4,064,587 | 12/1977 | Schnabl | 15/189 |
| 4,087,880 | 5/1978 | Clark, Jr. . | |
| 4,541,139 | 9/1985 | Jones et al. | 15/171 |
| 4,642,837 | 2/1987 | Nichols et al. | 15/145 |
| 5,371,916 | 12/1994 | Vosbikian . | |
| 5,590,437 | 1/1997 | McMillin | 15/189 |

*Primary Examiner*—Terrence R. Till
*Attorney, Agent, or Firm*—R. William Graham

[57] ABSTRACT

A broom having a handle with a threaded end and a broom head connected to the handle which includes a generally cylindrical sleeve made of plastic having a first end which defines an open surface extending therethrough and a second end which defines a reverse threaded open surface in communication with the open surface of the first end, wherein the open surfaces are configured to receive the threaded end of the handle and wherein the sleeve is employed in a method for winding a broom head which includes mating the sleeve to a threaded shaft, disposing broom corn about the sleeve, securing an end from a winding wire through the broom corn to the sleeve, clockwise rotating the shaft such that the winding wire wraps about the broom corn in a manner to secure the broom corn to the sleeve and connecting another end of the wire to the sleeve.

3 Claims, 3 Drawing Sheets

BROOM HAVING WIRE BOUND FIBERS

BACKGROUND OF THE INVENTION

1. Field of the Invention

The present invention relates to improvements in brooms wherein the broom head is made separate from the handle. More particularly, the invention relates to a novel broom having a broom head which includes a broom head sleeve and method of making a broom employing the same.

2. Related Art

The art of broom making is very extensive including myriads of designs for various purposes. Brooms commonly include a handle and broom head which has a plurality of debris gathering fibers. The fibers are arranged in rows in a side by side lengthwise manner and are bound together and attached to the handle directly or to a head which is then attached to the handle.

To save in costs of packaging, ship ping and shelf storage space, various designs for separate broom heads and handles have been made. This is desirable to the consumer for reasons that a consumer may need only replacement of a worn broom head or a broken handle.

Nevertheless, the art of making conventional wooden handle brooms with sewn broom corn fibers wound to the handle has remained popular and relatively unchanged. This is due to the fact that such broom making equipment is relatively simple and provides a consumer with an inexpensive product. In making such brooms, broom corn fibers are placed adjacent an end of the handle to become the broom head and a piece of winding is tacked through the broom corn fibers to the wooden handle end. A rotatable collet attaches to another end of the wooden handle and the handle is rotated to draw the winding about the broom corn fibers in a manner to secure the broom corn fibers to the handle wherein a terminal end of the winding is stapled or tacked to the wooden handle.

There is a desire and need to continue making this type of broom yet have a separate broom head and handle, and, for the reasons stated, employ the described conventional broom making equipment to accomplish the same. Presently, no such methods or devices are available to satisfactorily accomplish this.

BRIEF SUMMARY OF THE INVENTION

It is an object to improve brooms.

It is another object to improve broom manufacturing.

It is an object to solve the need described above by providing a broom corn type broom with a separable head and handle.

Other objects and advantages will be readily apparent to those skilled in the art upon viewing the drawings and reading the detailed description hereafter.

DETAILED DESCRIPTION OF THE INVENTION

Figure 1:
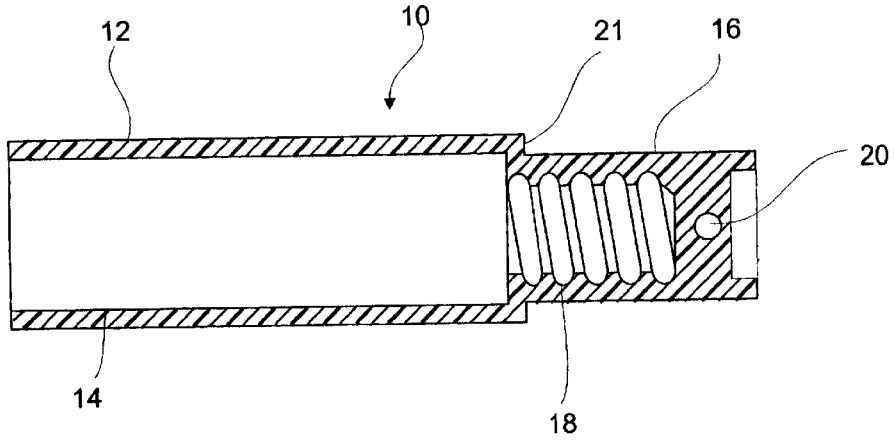
FIG. 1 shows a cross section of a broom sleeve of the present invention.

Referring to the drawings, the present invention includes a generally cylindrical seamless sleeve 10 for use in a novel method of making a broom corn type broom. As seen in FIG. 1, the sleeve 10 is preferably made of penetrable material, such as molded plastic, for reasons which will be apparent hereinafter. The sleeve 10 has a first end 12 which defines an open smooth surface 14 extending axially therethrough and a second end 16 which defines a reverse threaded open surface 18 extending partially axially therethrough and in communication with the open surface 14 of the first end 12. The second end 16 has a bored surface 20 extending radially therethrough. The outer diameter of the first end 12 is slightly larger than the outer diameter of the second end, thus forming a shoulder 21 therebetween.

Figure 2:
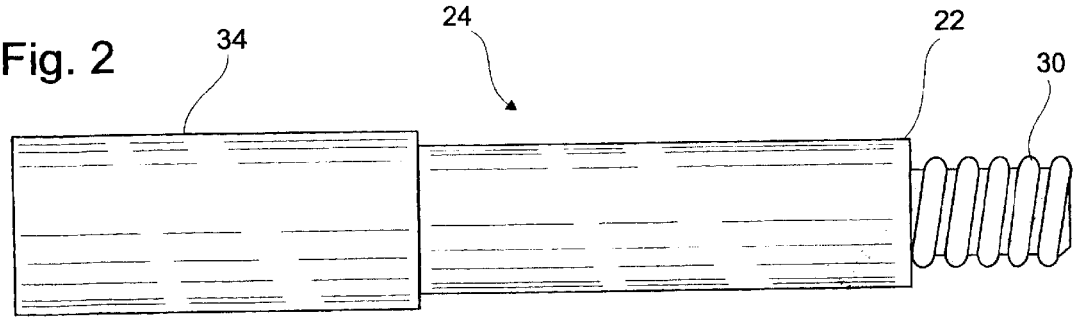
FIG. 2 shows a shaft for use in the method of the present invention.
Figure 7:
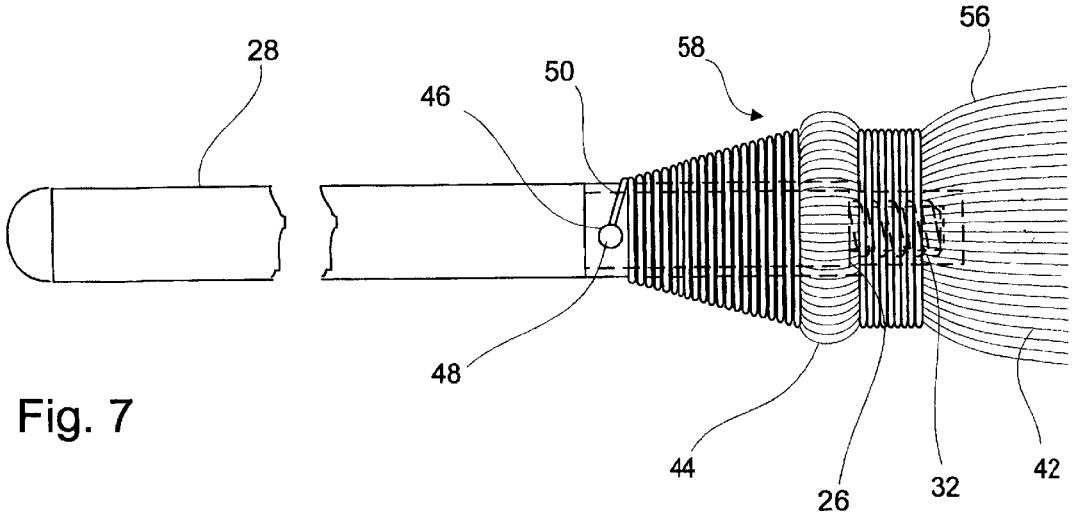
FIG. 7 shows a wooden handle inserted into the broom head depicted in FIG. 5 to form a broom.
Figure 8:
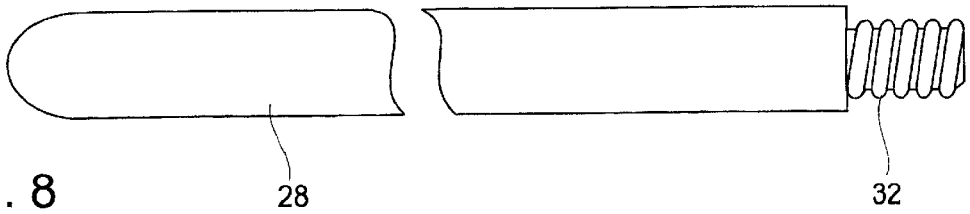
FIG. 8 shows a broom handle.

The open surfaces 14 and 18 are configured to receive an end 22 of shaft 24, as seen in FIG. 2, or end 26 of a broom 28 as seen in FIG. 7. Each of the ends 22 and 26 have a reverse threaded surface 30 and 32, respectively, to thread to the threaded surface 18.

Figure 3:
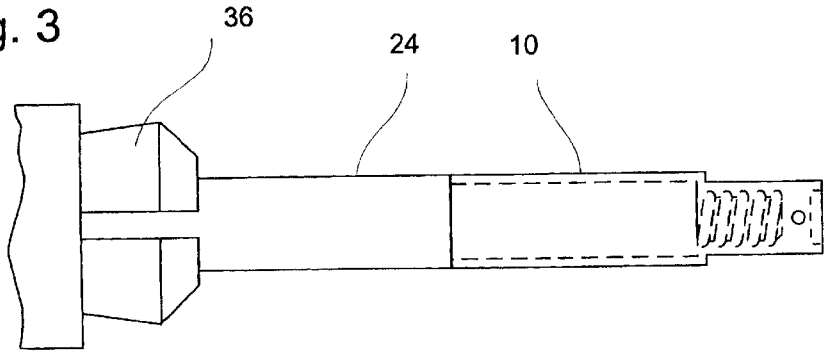
FIG. 3 shows the sleeve of FIG. 1 disposed on the shaft of FIG. 2 which is fixed to a collet for use in the present invention.

The shaft 24 is made of hardened relatively impenetrable material, such as steel, for reasons apparent hereinafter. The shaft 24 has an end 34 which is fixably connectable to a motorized rotatable collet 36, as seen in FIG. 3, wherein the collet 36 is connectable to a power source (not shown) to enable the shaft 24 to be rotated.

Figure 4:
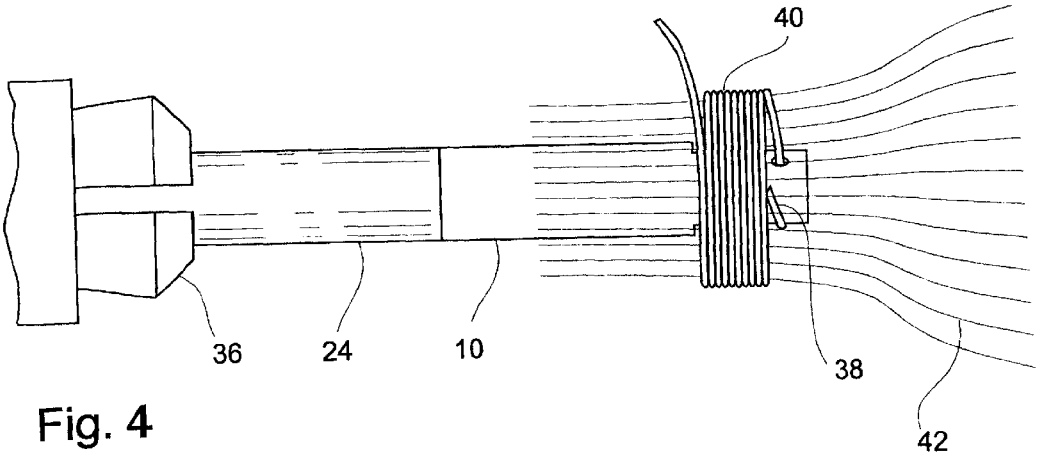
FIG. 4 shows winding about broom corn fibers being attached to the sleeve.
Figure 5:
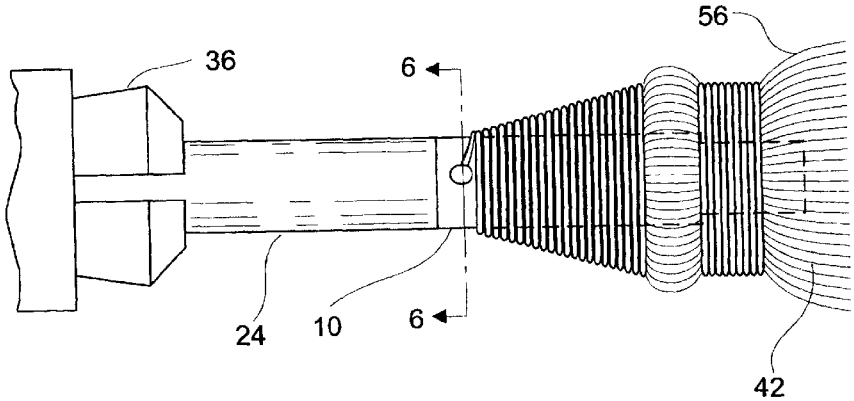
FIG. 5 shows winding about broom corn fibers having been attached to the sleeve to form a broom head.
Figure 6:
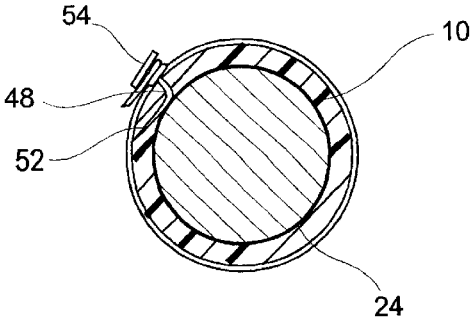
FIG. 6 shows a cross section of the sleeve, shaft and staple at line 6—6 in FIG. 5

In carrying out the invention, the sleeve 10 is threadably connected to the shaft 24 which is in turn connected to the collet 36. As seen in FIG. 4, an end 38 of winding wire 40 is passed through the bored surface 20 and tied off to secure the end 38 to the sleeve 10. Broom corn fibers 42 are placed adjacent the sleeve 10. While holding the wire 40 in a feeding manner, the collet 36 is powered to cause the rotation of the sleeve 10 in a clockwise direction. In this manner, the reverse threaded shaft 24 prevents the sleeve 10 from backing out of or off of the shaft 24 during the winding process. As the sleeve 10 rotates, the wire 40 wraps about the broom corn 42 to tightly bind the same to the second end 16. The initial winding proceeds up to the shoulder 21 whereat a portion of the broom corn 44, as seen in FIG. 7, is left unbound. The winding continues about the remainder of the broom corn 42 and first end 12 of the sleeve 10 to a terminal point 46 of the sleeve 10. At this point the rotation of the collet 36 and in turn the sleeve is stopped.

A tack 48 made of metal, for example, is positioned adjacent the terminal point 46 having a piece 50 of the wire 40 wrapped about an elongated end 52 of the tack 48. The elongated end 52 is driven through the plastic sleeve 10, deflected off the shaft 24 and back into the sleeve 10 to securely interlock the tack 48 to the sleeve 10 such that the tack 48 extends through the end 12 in an manner which does not penetrate radially inward of the open smooth surface 14 and takes on a general J-shape. A head 54 of the tack 48 together with the elongated end 52 secure the wire piece 50 to the sleeve 10. Any remainder of the wire 40 beyond piece 50 can be cut off.

At this point, there is formed a newly formed broom head 56 which can be unthreaded from the shaft 24. In this case, the broom head 56 is threaded to the handle 28 to form a broom 58 contemplated by the present invention.

The above described embodiments are set forth by way of example and are not for the purpose of limiting the present invention. It will be readily apparent to those skilled in the art that obvious modifications and variations can be made to the embodiment without departing from the scope of the invention. Accordingly, the claims appended hereto should be read in their full scope including any such modifications and variations.

What is claimed is:

1. A broom corn fiber type broom, which includes:

a broom head having a seamless plastic sleeve having a first end which defines an open smooth surface extending axially therethrough and a second end which defines axially therein a threaded open surface in communication with the open surface of the first end, a plurality of broom corn fibers disposed adjacent an outer surface of said sleeve, and means connected to said sleeve for binding said broom corn fibers to said sleeve, wherein said binding means includes a wire wound about said broom corn fibers and a tack having a head disposed outside said sleeve and a generally J-shaped enlongated portion extending through said first end in an manner which interlocks said tack to said sleeve and does not penetrate radially inward of said open surface and wherein said head interlocks an end of said wire to said sleeve; and a handle having an outer diameter less than a diameter of said open smooth surface of said first end of said sleeve and having an end having an outer diameter less than a diameter of said threaded surface of said second end of said sleeve and threaded in a complimentary manner to be received therein, and wherein said handle is threadably connected to said broom head.

2. A broom corn fiber type broom, which includes:

a broom head having a plastic seamless sleeve having a first end which defines an open smooth surface extending axially therethrough and a second end which defines axially therein a threaded open surface in communication with the open surface of the first end, a plurality of broom fibers disposed adjacent an outer surface of said sleeve and means connected to said sleeve for binding said broom corn fibers to said sleeve, wherein said sleeve has a bored surface extending radially therethrough, and said binding means includes a wire wound about said broom corn fibers and having one end connected to said sleeve through said bored surface and a tack having a head disposed outside said sleeve and a generally J-shaped enlongated portion extending through said first end in an manner which interlocks said tack to said sleeve and extends through said first end in an manner which does not penetrate radially inward of said open surface and wherein said head interlocks another end of said wire to said sleeve: and a handle having an outer diameter less than a diameter of said open surface of said first end of said sleeve and having an end having outer diameter less than a diameter of said threaded surface of said second end of said sleeve and threaded in a complimentary manner to be received therein, and wherein said handle is threadably connected to said broom head.

3. The broom of claim 1, wherein said first end of said handle has an outer diameter greater than an outer diameter of said second end forming a shoulder therebetween.

* * * * *